US007127192B2

(12) United States Patent
Batori et al.

(10) Patent No.: US 7,127,192 B2
(45) Date of Patent: Oct. 24, 2006

(54) DEVELOPING FRAME AND PROCESS CARTRIDGE

(75) Inventors: Yoshiyuki Batori, Shizuoka (JP); Hiroki Ogino, Shizuoka (JP); Masanari Morioka, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 120 days.

(21) Appl. No.: 10/925,974

(22) Filed: Aug. 26, 2004

(65) Prior Publication Data

US 2005/0078977 A1 Apr. 14, 2005

(30) Foreign Application Priority Data

Aug. 29, 2003 (JP) ..... 2003-307911

(51) Int. Cl.
*G03G 15/08* (2006.01)

(52) U.S. Cl. ..... 399/104; 399/111

(58) Field of Classification Search ..... 399/102, 399/103, 104, 105, 111, 119, 113
See application file for complete search history.

(56) References Cited

U.S. PATENT DOCUMENTS

| | | | | |
|---|---|---|---|---|
| 5,774,766 | A * | 6/1998 | Karakama et al. | 399/111 |
| 5,911,096 | A | 6/1999 | Batori et al. | 399/111 |
| 5,920,753 | A | 7/1999 | Sasaki et al. | 399/111 |
| 5,930,562 | A | 7/1999 | Noda et al. | 399/114 |
| 5,937,237 | A | 8/1999 | Nonaka et al. | 399/106 |
| 5,940,658 | A | 8/1999 | Yokoi et al. | 399/119 |
| 6,075,957 | A | 6/2000 | Batori et al. | 399/114 |
| 6,101,348 | A | 8/2000 | Nonaka et al. | 399/103 |
| 6,131,007 | A | 10/2000 | Yamaguchi et al. | 399/256 |
| 6,185,393 | B1 | 2/2001 | Karakama et al. | |
| 6,266,500 | B1 * | 7/2001 | Numagami et al. | 399/104 |
| 6,275,668 | B1 | 8/2001 | Batori | 399/90 |
| 6,334,035 | B1 | 12/2001 | Abe et al. | 399/106 |
| 6,363,226 | B1 | 3/2002 | Batori | 399/8 |
| 6,438,340 | B1 | 8/2002 | Sato | 399/103 |
| 6,512,895 | B1 * | 1/2003 | Sakurai et al. | 399/111 X |
| 6,704,522 | B1 | 3/2004 | Sasago et al. | 399/12 |
| 6,714,746 | B1 | 3/2004 | Morioka et al. | 399/27 |
| 2003/0235429 | A1 | 12/2003 | Sato et al. | 399/111 |
| 2004/0013446 | A1 | 1/2004 | Morioka et al. | 399/111 |
| 2004/0037590 | A1 | 2/2004 | Morioka et al. | 399/167 |

FOREIGN PATENT DOCUMENTS

| | | |
|---|---|---|
| JP | 06-134866 | 5/1994 |
| JP | 11-143225 A | 5/1999 |
| JP | 2001-305859 A | 11/2001 |

* cited by examiner

*Primary Examiner*—Sandra I. Brase
(74) *Attorney, Agent, or Firm*—Fitzpatrick, Cella, Harper & Scinto

(57) ABSTRACT

A developing frame which can improve a sealing property for developer at the end portion of a developing roller. The developing frame has a first frame member having a developer supplying opening provided to supply a developer from a developer containing portion containing the developer to a developing area, a second frame member joined to the first frame member by molten resin, an attachment portion, a seal member for preventing the developer from leaking from the lengthwise end portion of the developing roller being attached to the attachment portion, and a resin reservoir depressed from the joint surface of the first frame member and the second frame member toward the attachment portion, and in which the molten resin is stored.

8 Claims, 14 Drawing Sheets

DEVELOPING FRAME AND PROCESS CARTRIDGE

BACKGROUND OF THE INVENTION

1. Field of the Invention

The invention relates to a developing frame, a process cartridge and an electrophotographic image forming apparatus.

Here, the electrophotographic image forming apparatus is an apparatus for forming an image on a recording medium (such as, for example, recording paper, an OHP sheet or cloth) by the use of an electrophotographic image forming process. Examples of the electrophotographic image forming apparatus include, for example, an electrophotographic copying machine, an electrophotographic printer (such as, for example, a laser printer or an LED printer), a facsimile apparatus, a word processor and a compound machine (such as a multifunction printer) of these.

Also, the term "process cartridge" refers to at least developing means as process means and an electrophotographic photosensitive drum integrally made into a cartridge which is detachably mountable on an electrophotographic image forming apparatus main body. Also, the term "developing frame" refers to joined frame members for holding members constituting a portion of the afore described developing means, such as, for example, a developer containing portion containing a developer therein, and a developing portion for developing an electrostatic latent image formed on the electrophotographic photosensitive drum by the use of the developer.

2. Related Background Art

Heretofore, in the electrophotographic image forming apparatus, there has been adopted a process cartridge system in which an electrophotographic photosensitive drum (hereinafter referred to as the "photosensitive drum") and process means for acting on the photosensitive drum are integrally made into a cartridge, which is made detachably mountable on an image forming apparatus main body. According to this process cartridge system, the maintenance of the apparatus can be done by an operator himself without resort to a serviceman. Therefore, this process cartridge system is widely used in electrophotographic image forming apparatuses.

A construction shown in FIG. 20 of the accompanying drawings is known as the aforedescribed process cartridge (see U.S. Pat. No. 6,438,340).

As shown in FIG. 21 of the accompanying drawings, the welding of a toner developing frame member 101 and a toner developing wall member 102 is effected by a welding horn 133 for imparting ultrasonic vibration, and an anvil 134 when the welding horn 133 is brought into pressure contact. The toner developing frame member 101 and the toner developing wall member 102 are held so that surfaces 131 and 132 may get astride the anvil 134. The toner developing wall member 102 is brought into pressure contact while ultrasonic vibration is imparted thereto by the welding horn 133. Thereby, a welding rib is melted and the toner developing frame member 101 and the toner developing wall member 102 are welded together (see U.S. Pat. No. 6,438,340).

As shown in FIG. 20, a developer leakage seal for preventing the leakage of a developer from the end portions of a developing roller is stuck on the surfaces 131 and 132 by means of a two-side tape or the like. Thereafter, the developing roller is incorporated into a developing frame.

By this developer leakage seal, the developer is prevented from leaking from the end portions of the developing roller.

SUMMARY OF THE INVENTION

The present invention is the further development of the above-described conventional art.

It is an object of the present invention to provide a developing frame and a process cartridge which can improve a sealing property for a developer in the end portions of a developing roller.

It is another object of the present invention to provide a developing frame and a process cartridge in which resin does not swell out from between frame members when the frame members are joined together by resin.

It is another object of the present invention to provide a developing frame and a process cartridge in which resin is prevented from swelling out from between frame members when the frame members are joined together by resin, whereby seal members can be accurately attached to the frame members.

It is another object of the present invention to provide a developing frame or a process cartridge having:

a first frame member having a developer supplying opening provided to supply a developer from a developer containing portion containing the developer therein to a developing area;

a second frame member joined to the first frame member by molten resin;

an attachment portion provided on at least the first frame member and having attached thereto a seal member for preventing the developer from leaking from the lengthwise end portions of a developing roller; and a resin reservoir recessed from the joined surface of the first frame member and the second frame member toward the attachment portion and in which the distal end portion of the first frame member lying on a side opposite to a side on which the developer containing portion is provided with the developer supplying opening interposed therebetween is depressed, and in which the molten resin is stored.

It is another object of the present invention to provide a developing frame or a process cartridge having:

a first frame member having a developer supplying opening provided to supply a developer from a developer containing portion containing the developer therein to a developing area;

a second frame member joined to the first frame member by molten resin;

an attachment portion provided on at least the first frame member, and having attached thereto a seal member for preventing the developer from leaking from the lengthwise end portions of a developing roller; and a resin reservoir in which the molten resin is stored and which extends from the joined surface of the first frame member and the second frame member toward the attachment portion and in which the distal end portion of the first frame member lying on the opposite side (developing chamber side) to a side on which the developer containing portion is provided with the developer supplying opening interposed therebetween and is recessed.

These and other objects, features and advantages of the present invention will become more apparent upon consideration of the following description of the preferred embodiments of the present invention taken in conjunction with the accompanying drawings.

DETAILED DESCRIPTION OF THE PREFERRED EMBODIMENTS

The best form for carrying out this invention will hereinafter be described in detail by way of example with reference to the drawings and some embodiments. The dimensions, materials, shapes, relative disposition, etc., of constituent parts described in those embodiments, unless particularly described, are not intended to restrict the scope of this invention thereto. Also, the materials, shapes, etc. of members once described in the following description, unless newly described, are similar to those described at first.

Also, in the following description, the lengthwise direction of a process cartridge is a direction intersecting (substantially orthogonal to, or the lengthwise direction of a developing roller) a direction in which the process cartridge is mounted and dismounted with respect to an apparatus main body. The lengthwise direction of the process cartridge is also the lengthwise direction of an electrophotographic photosensitive drum. The upper surface of the process cartridge is a surface overlying the process cartridge in a state in which the process cartridge is mounted on the apparatus main body, and the lower surface of the process cartridge is a surface underlying the process cartridge in such state.

FIRST EMBODIMENT (Description of the General Construction of an Electrophotographic Image Forming Apparatus)

Figure 1:
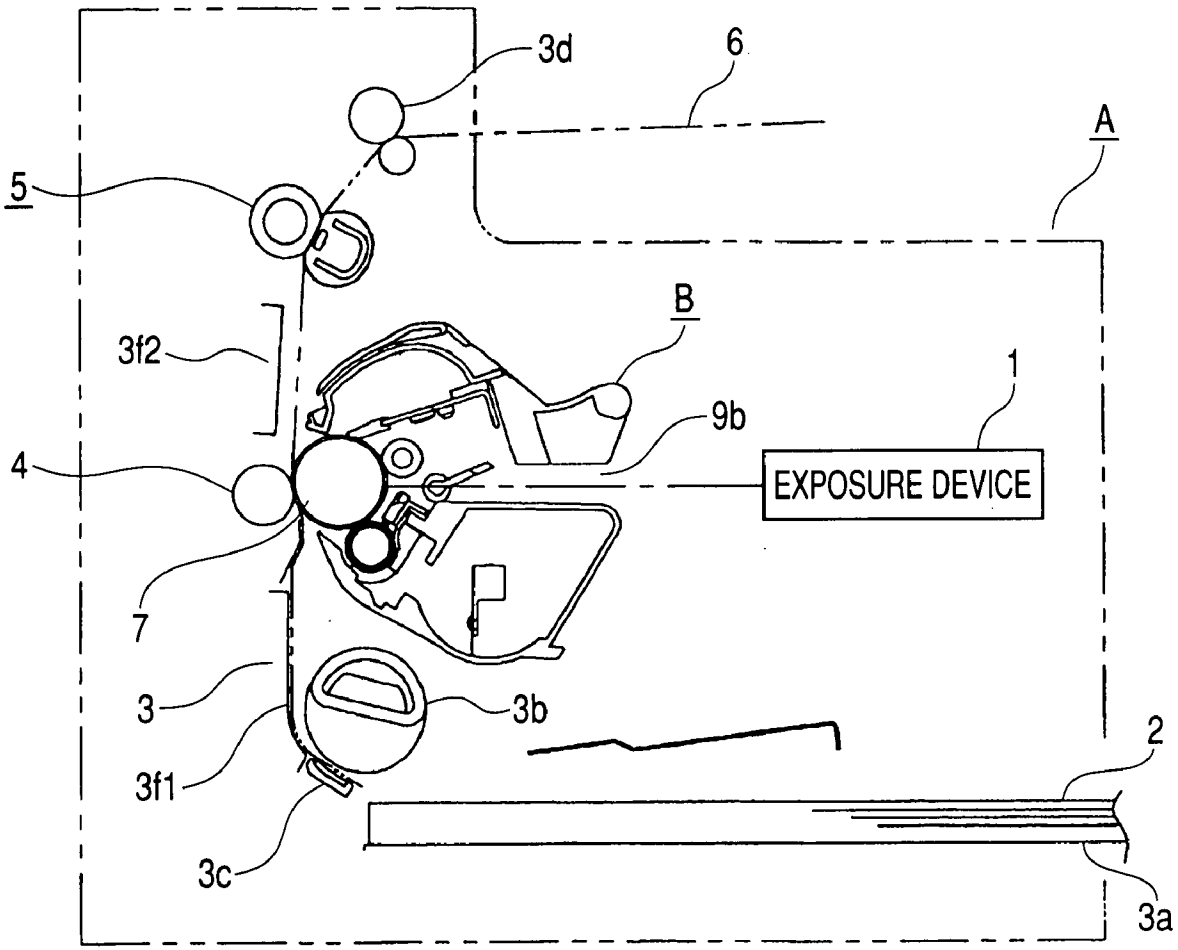
FIG. 1 is a cross-sectional view of an electrophotographic image forming apparatus according to an embodiment of the present invention.

The general construction of an electrophotographic image forming apparatus according to the present embodiment will first be described with reference to FIG. 1. FIG. 1 is a cross-sectional view of the electrophotographic image forming apparatus according to the present embodiment.

As shown in FIG. 1, the electrophotographic image forming apparatus (laser beam printer, hereinafter referred to as the "image forming apparatus") A has an exposure device 1 as optical means. This exposure device 1 applies information light based on image information to an electrophotographic photosensitive drum (hereinafter referred to as the "photosensitive drum") 7 of a process cartridge (hereinafter referred to as the "cartridge") B . Thus, an electrostatic latent image is formed on the photosensitive drum 7. This electrostatic latent image is developed with a developer. As a result, a developer image is formed on the photosensitive drum 7. While in the following, a description will be provided of the case of a one-component developer comprising chiefly a toner, this is not restrictive, but even a two-component developer comprising chiefly a carrier and a toner can also be suitably adopted.

In synchronism with the forming of the developer image, recording media 2 are separated and fed one by one from a cassette 3*a* by a pickup roller 3*b* and a pressure contact member 3*c* brought into pressure contact therewith. Then, the recording medium 2 is conveyed to a transfer roller 4 along a conveying guide 3*f*1. The developer image formed on the photosensitive drum 7 is transferred to the recording medium 2 by the transfer roller 4 to which a voltage has been applied. Thereafter, the recording medium 2 is conveyed to fixing means 5 along a conveying guide 3*f*2.

The fixing means 5 applies heat and pressure to the passing recording medium 2. Thus, the developer image is fixed on the recording medium 2. The recording medium 2 is then conveyed by discharge rollers 3*d*, and is discharged to a discharging portion 6.

In the present embodiment, conveying means 3 is constituted by the pickup roller 3*b*, the pressure contact member 3*c*, the discharge rollers 3*d*, etc.

(Process Cartridge)

Figure 2:
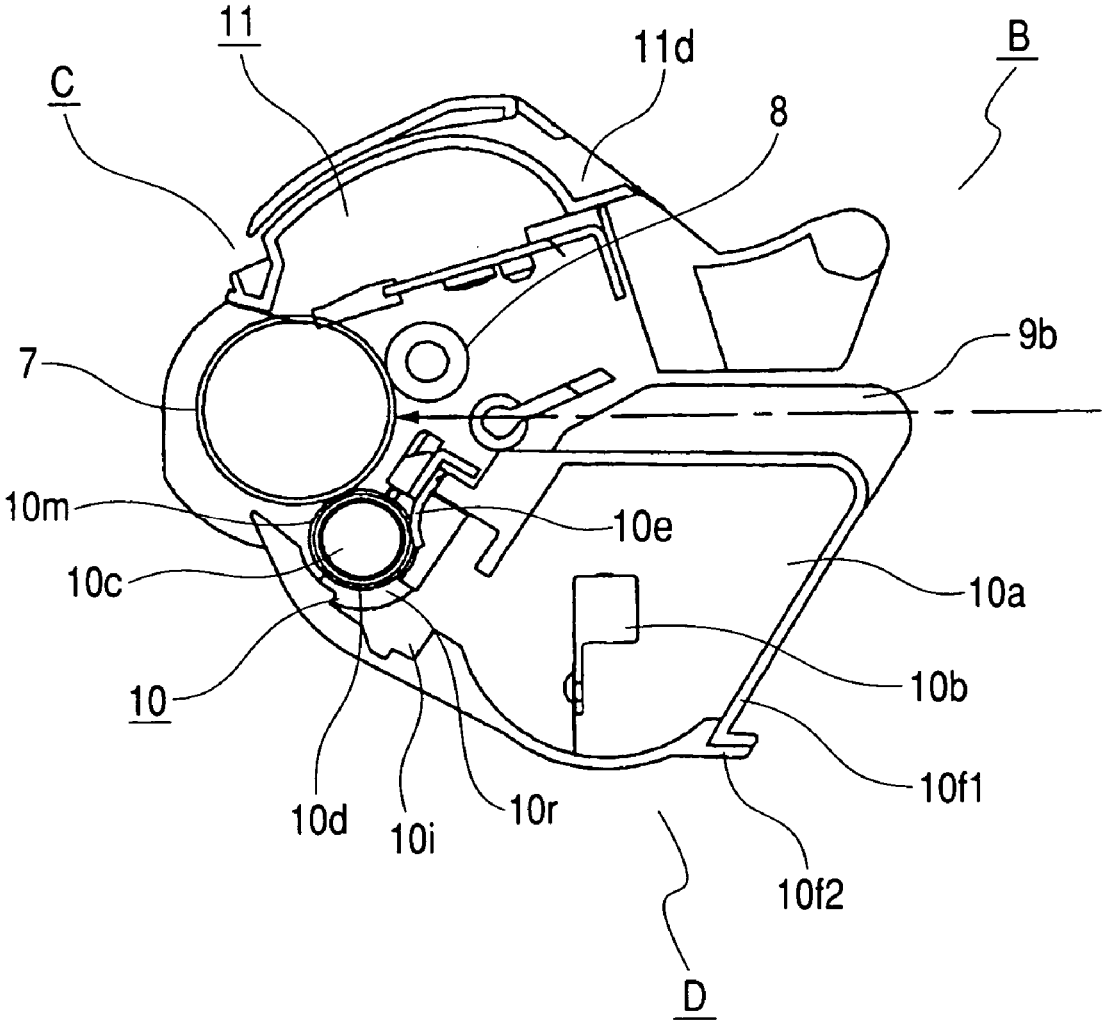
FIG. 2 is a cross-sectional view of a process cartridge according to the present embodiment.

The general construction of a process cartridge detachably mountable on the electrophotographic image forming apparatus according to the present embodiment will now be described with reference to FIG. 2. FIG. 2 is a cross-sectional view of the process cartridge according to the present embodiment.

The process cartridge (hereinafter referred to as the "cartridge") B is such that a cleaning apparatus C for rotatably supporting the photosensitive drum 7 is rockably coupled to a developing apparatus D. The cartridge B has a developing frame. The developing frame is comprised of a first developing frame member 10*f*1 (hereinafter referred to as the "first frame member"), and a second developing frame member 10*f*2 (hereinafter referred to as the "second frame member"). The first frame member 10*f*1 is made of resin, and has a developer supplying opening 10*k* for supplying a developer from a developer containing portion 10*a* containing the developer therein to a developing area (developing chamber 10*i*). The second frame member 10*f*2 is also made of resin, and is integrally coupled to the first frame member 10*f*1 by welding. Also, the photosensitive drum 7, a charging roller 8, etc., are contained in a cartridge frame member constituted by the developing frame and a cleaning frame member 11*d* being coupled together, and are made into a cartridge.

That is, the first frame member 10*f*1 and the second frame member 10*f*2 are welded together to thereby constitute the developer containing portion 10*a* and the developing chamber 10*i*. A developing roller 10*d* and a developing blade 10*e* are mounted in the developing chamber 10*i*. Also, the photosensitive drum 7, the charging roller 8 and each member constituting cleaning means 11 are mounted in the cleaning frame member 11*d*. Also, on the upper surface of the cleaning frame member 11*d*, a handle portion is provided integrally with the cleaning frame member 11*d*.

The first frame member 10*f*1 and the second frame member 10*f*2 are formed by the injection molding of resin. As an example of a material used for the two frame members, use can be suitably be made of HI-PS (high impact-polystyrene) optimum for welding joint, ABS (acrylnitrilebutadienestyrene) or the like.

In case of image forming, the photosensitive drum 7 having a photosensitive layer is first rotated. Then, the surface of the photosensitive drum 7 is uniformly charged by the charging roller 8 to which a voltage has been applied. The photosensitive drum 7 is then exposed to information light (an optical image) based on image information from the exposure device 1 through an exposure opening 9*b*. Thus, an electrostatic latent image is formed on the photosensitive drum 7. This electrostatic latent image is developed by developing means 10 of the developing apparatus D.

(Developing Apparatus)

Figure 3:
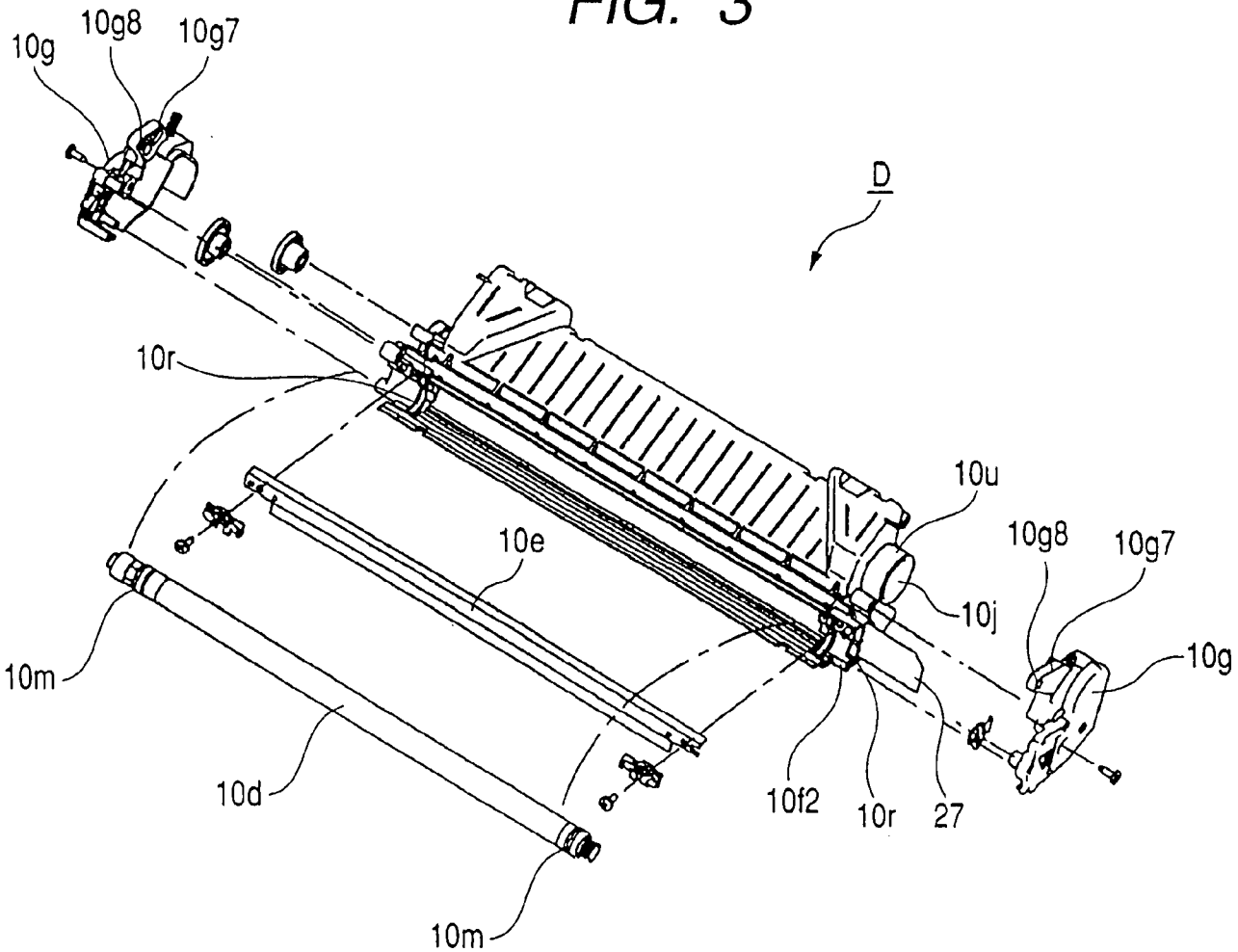
FIG. 3 is an exploded perspective view of a developing apparatus according to the present embodiment.
Figure 4:
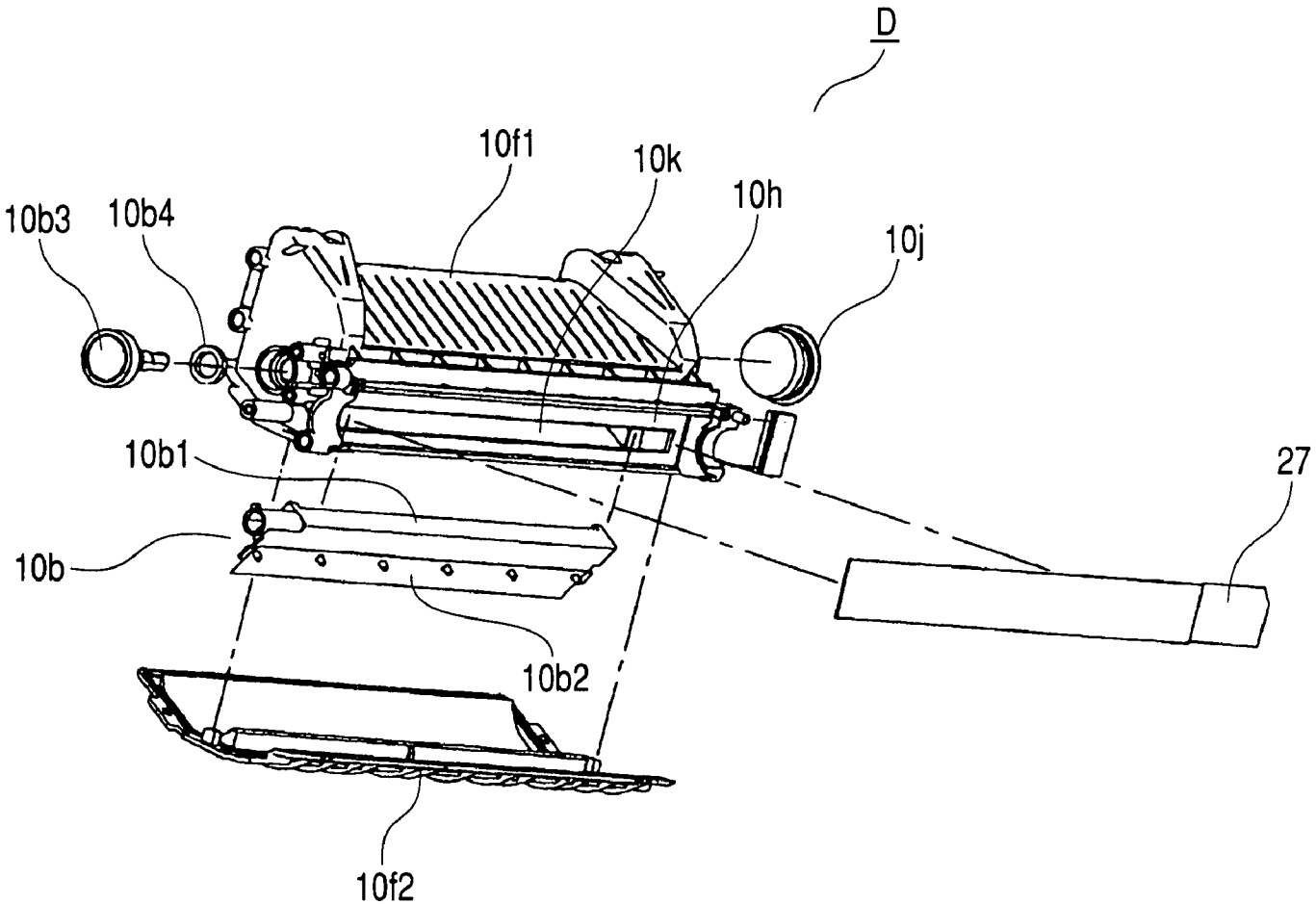
FIG. 4 is an exploded perspective view of the developing apparatus according to the present embodiment.

The developing apparatus D incorporated in the cartridge B will now be described with reference to FIGS. 2 to 4. FIGS. 3 and 4 are exploded perspective views of the developing apparatus according to the present embodiment.

The developing apparatus D has the first frame member 10*f*1 and the second frame member 10*f*2 forming the developer containing portion 10*a*, holder members (hereinafter referred to as the end portion members) 10*g*, a developing roller 10*d* for carrying the developer to the photosensitive drum 7 and developing the electrostatic latent image thereon, and parts for electrically energizing the developing roller 10*d*. The developing apparatus D further has a developing blade 10*e* for regulating the layer thickness of the developer on the developing roller 10*d*, and seal members 10*r* for preventing the developer from leaking outwardly from the opposite end portions of the developing roller 10*d* (see FIG. 3).

The first frame member 10*f*1 is supported for pivotal movement so that the developing roller 10*d* may be parallel and opposed to the photosensitive drum 7 with a predetermined interval therebetween. Also, gap holding members 10*m* (see FIG. 3) for holding the interval between the developing roller 10*d* and the photosensitive drum 7 are disposed in the opposite end portions of the developing roller 10*d*.

As shown in FIG. 3, the end portion members 10*g* are attached to the opposite sides of the first frame member 10*f*1. Also, the end portion members 10*g* have arm portions 10*g*7. The arm portions 10*g*7 are formed with coupling holes 10*g*8 for rockably suspending the developing apparatus D relative to the cleaning apparatus C.

As shown in FIG. 4, the first frame member 10*f*1 has an agitating shaft 10*b*1 for supplying the developer. A sheet member 10*b*2 is fixed to the agitating shaft 10*b*1. A conveying gear 10*b*3 for regulating drive transmission and the length of the agitating shaft 10*b*1, together with a seal member 10*b*4 for preventing the outflow of the developer to the outside of the first frame member 10*f*1, is coupled to the agitating shaft 10*b*1.

Also, the first frame member 10*f*1 is formed with a developer supplying opening 10*k* through which the developer contained in the developer containing portion 10*a* passes when supplied to the developing roller 10*d*.

Also, as shown in FIG. 4, a developer seal member 27 is heated and fixed to a seal attaching portion 10*h* provided along the four side edges of the developer supplying opening 10*k*. Also, as shown in FIG. 3, a developer filling port 10*u* for filling the developer containing portion 10*a* with the developer is formed in one lengthwise end portion of the first frame 10*f*1. After the developer containing portion 10*a* has been filled with the developer, the developer filling port 10*u* is sealed by a cap member 10*j*.

The developer contained in the developer containing portion 10*a* is sent out to the developing roller 10*d* by a sending member 10*b*. Therewith, a developer layer is formed on the developing roller 10*d* by the magnetic force of a stationary magnet 10*c*. Then, the electrostatic latent image formed on the photosensitive drum 7 is developed by the developer on the developing roller 10*d* to which a developing bias has been applied.

(Construction of the Developing Frame)

Figure 5:
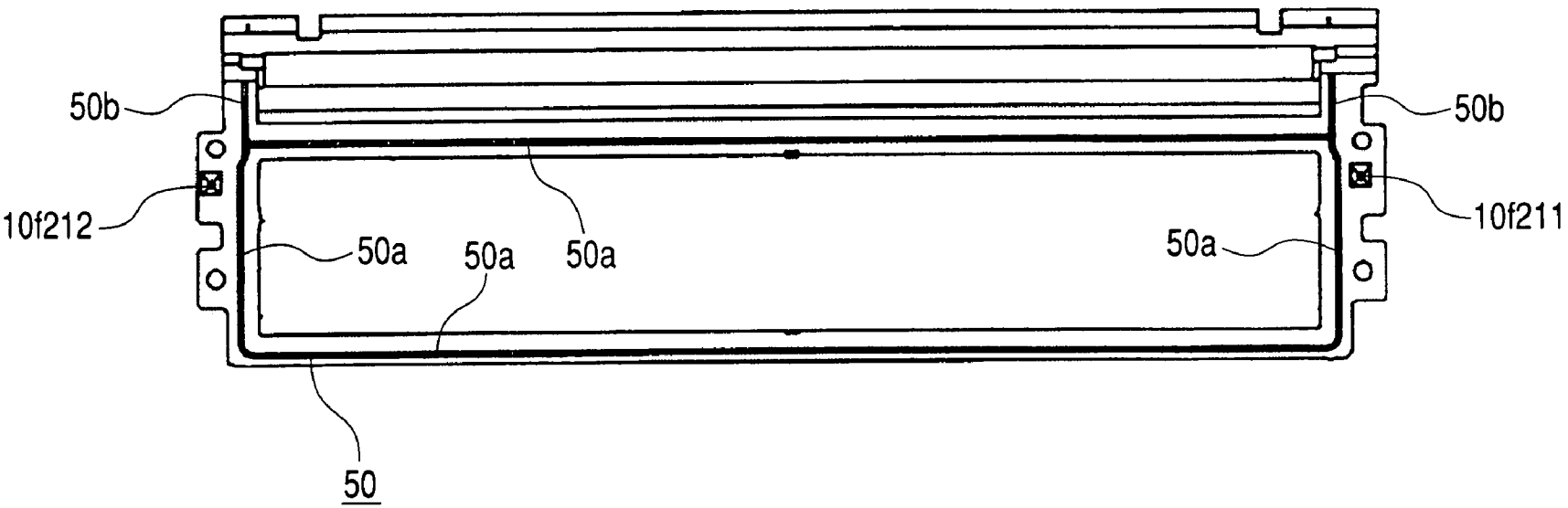
FIG. 5 is a top plan view of a second developing frame member according to the present embodiment before joined.
Figure 6:
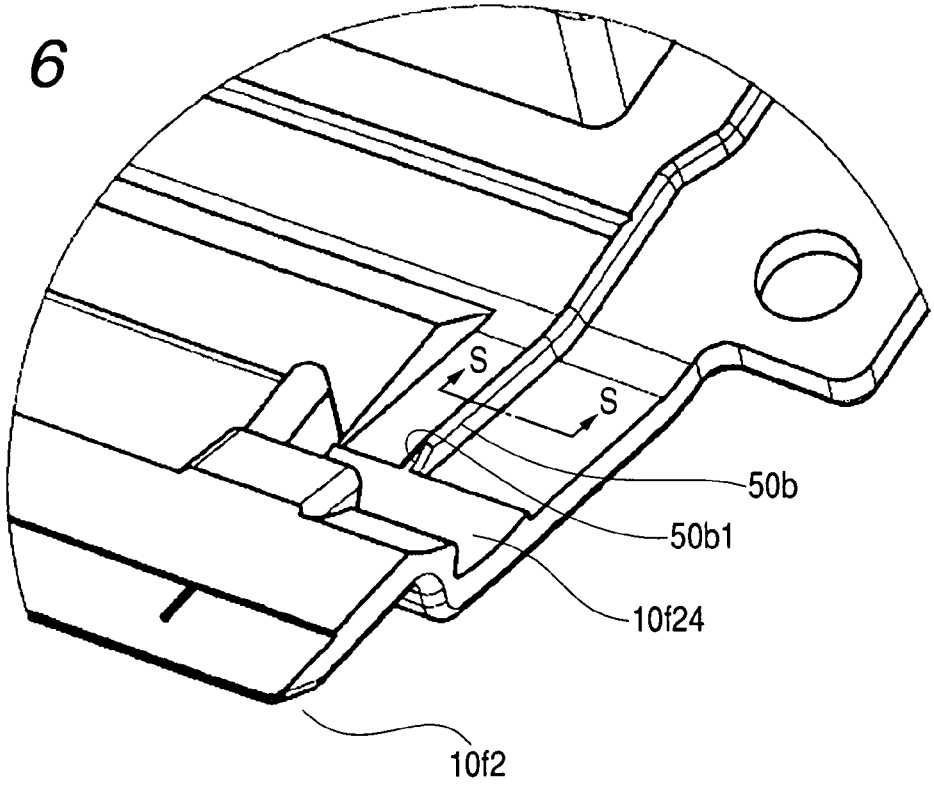
FIG. 6 is a fragmentary perspective view of the second developing frame member according to the present embodiment before joined.
Figure 7:
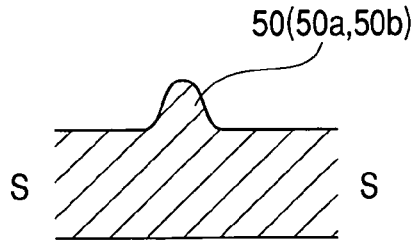
FIG. 7 is a cross-sectional view of a welding rib according to the present embodiment.
Figure 8:
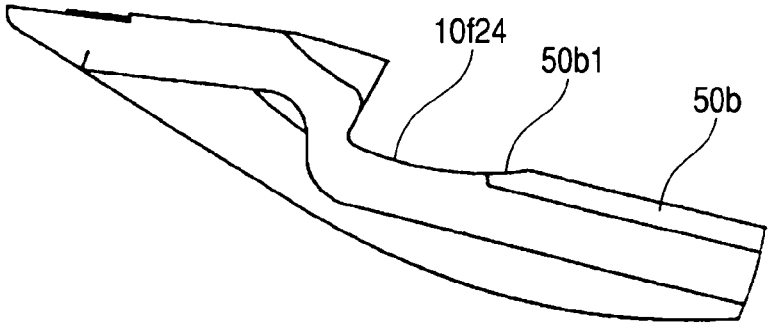
FIG. 8 is a fragmentary side view illustrating the developing welding rib of the second developing frame member.
Figure 9:
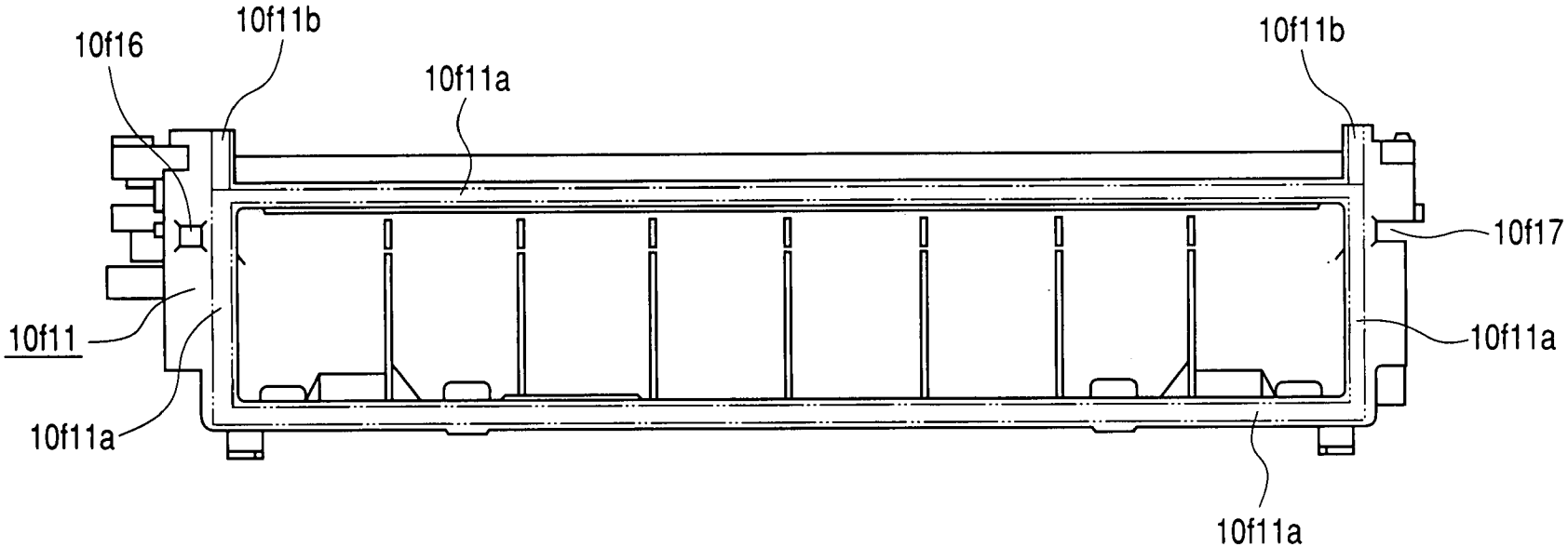
FIG. 9 is a bottom view of a first developing frame member according to the present embodiment before joined.
Figure 10:
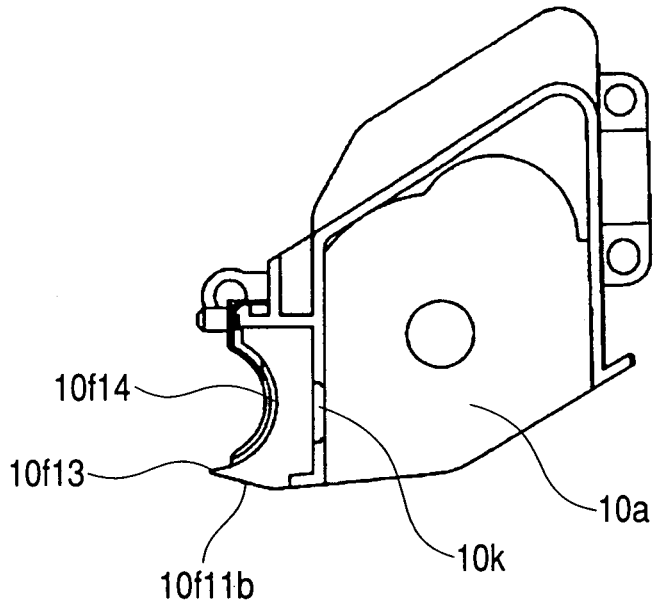
FIG. 10 is a cross-sectional view of the first developing frame member according to the present embodiment before joined.
Figure 11:
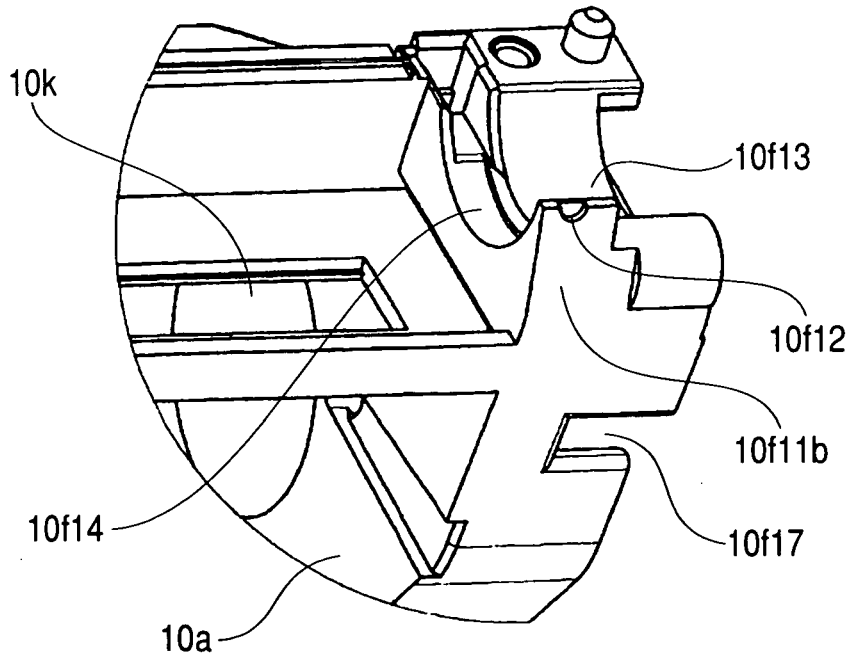
FIG. 11 is a fragmentary perspective view of the first developing frame member according to the present embodiment before joined.
Figure 12:
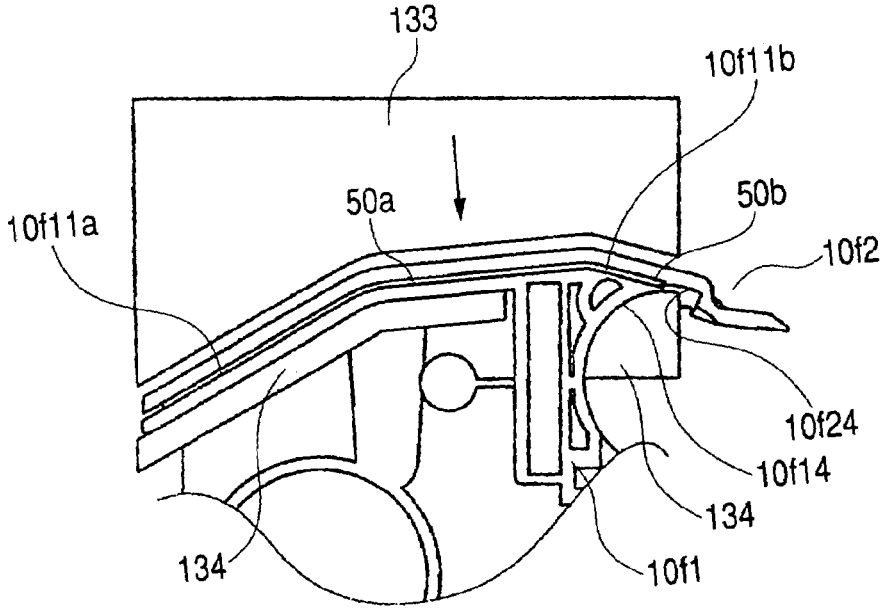
FIG. 12 is a fragmentary cross-sectional view showing a manner in which the first developing frame member and the second developing frame member according to the present embodiment are joined together.
Figure 13:
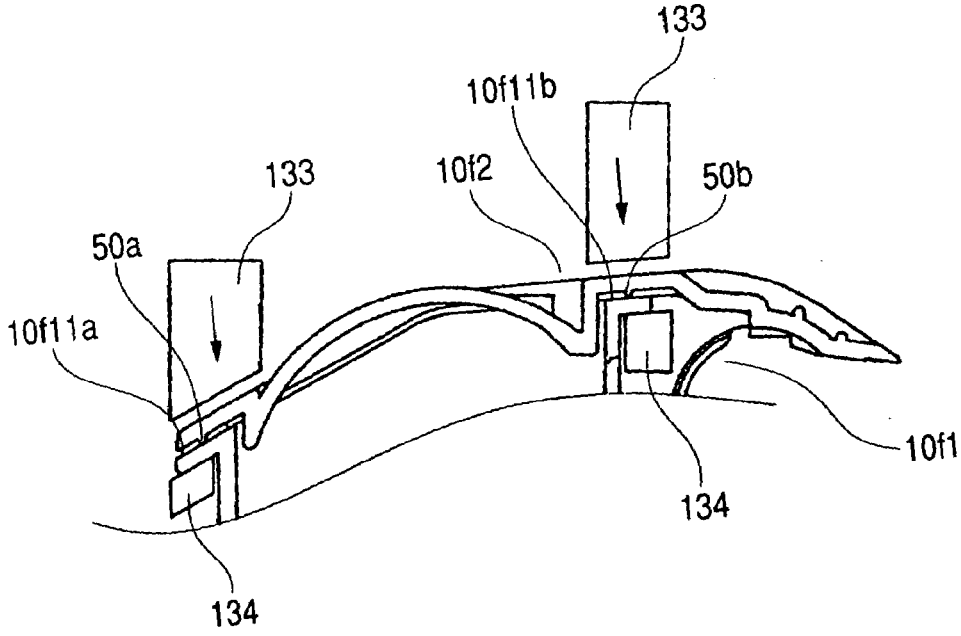
FIG. 13 is a fragmentary cross-sectional view showing the manner in which the first developing frame member and the second developing frame member according to the present embodiment are joined together.
Figure 14A:
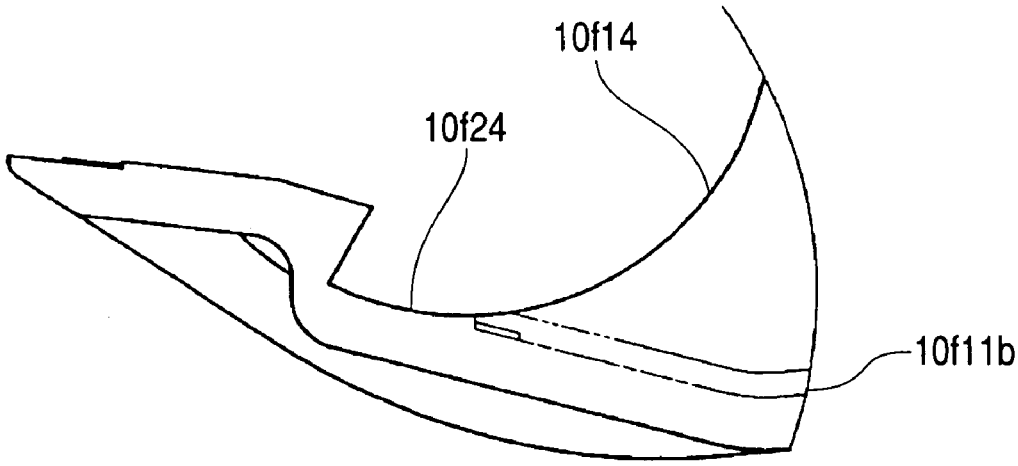
FIGS. 14A and 14B are fragmentary cross-sectional views for illustrating a state in which the first developing frame member and the second developing frame member have been joined together.
Figure 14B:
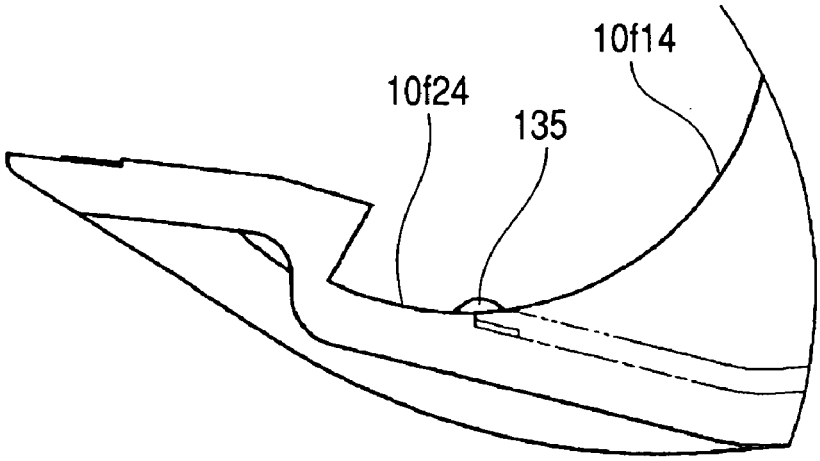
Figure 15:
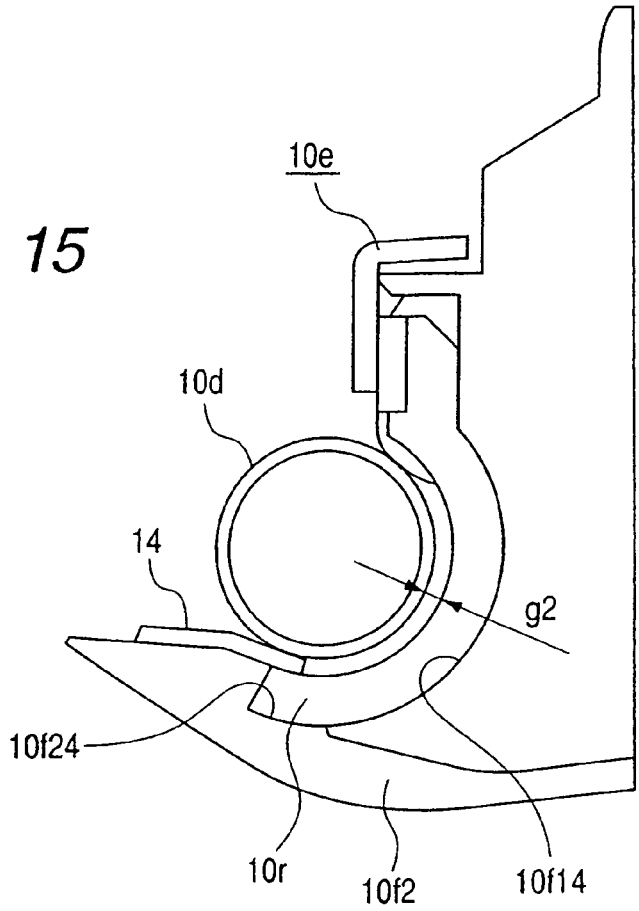
FIG. 15 is a fragmentary cross-sectional view showing a state in which a developer seal member at an end portion of a developing roller has been assembled.
Figure 16:
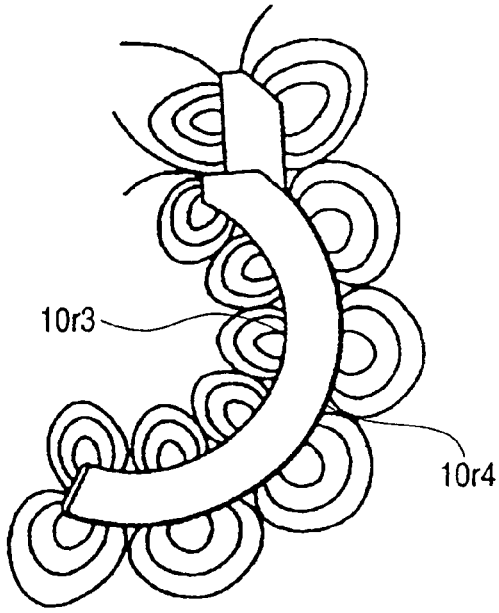
FIG. 16 is a typical schematic view for illustrating a situation of generation of a magnetic field in the seal member.

The construction of the developing frame will now be described in detail with reference to FIGS. 5 to 16. FIG. 5 is a top plan view of a second developing frame member according to the present embodiment before joined. FIG. 6 is a fragmentary perspective view of the second developing frame member according to the present embodiment before joined. FIG. 7 is a cross-sectional view of a welding rib according to the present embodiment. FIG. 8 is a fragmentary side view illustrating the welding rib of the second developing frame member according to the present embodiment. FIG. 9 is a bottom view of a first developing frame member according to the present embodiment before joined. FIG. 10 is a cross-sectional view of the first developing frame member according to the present embodiment before joined. FIG. 11 is a fragmentary perspective view of the first developing frame member according to the present embodiment before joined. FIGS. 12 and 13 are fragmentary cross-sectional views showing a manner in which the first developing frame member and the second developing frame member according to the present embodiment are joined together. FIGS. 14A and 14B are fragmentary cross-sectional views for illustrating a state in which the first developing frame member and the second developing frame member have been joined together. FIG. 15 is a fragmentary cross-sectional view showing a state in which the developer seal members in the end portions of the developing roller have been assembled. FIG. 16 is a typical schematic view for illustrating the situation of generation of a magnetic field in the seal member.

As shown in FIGS. 5 and 6, the second frame member 10*f*2 has a welding rib 50. The welding rib 50 comprises a developer containing portion rib 50*a* surrounding the periphery of the developer containing portion 10*a*, and developing portion ribs 50*b* disposed on the opposite outer sides of the developing chamber 10*i* and near the opposite end portions of the developing roller 10*d*.

As shown in FIG. 7, the welding rib 50 has a cross section formed into a substantially triangular shape. The developing portion ribs 50*b* are provided continuously to an arcuate attachment portion 10*f*24 to which a seal member 10*r* to be described is attached. The developing portion rib 50*b* near the attachment portion 10*f*24 has a localized surface portion 50*b*1 flush with the surface of the attachment portion 10*f*24 (see FIG. 8).

On the other hand, the first frame member 10*f*1 has a joint surface 10*f*11 to which the welding rib 50 of the second frame member 10*f*2 is welded and joined (see FIG. 9).

The joint surface 10*f*11 is a continuous surface comprised of a flat surface and a curved surface, and has a first joint surface 10*f*11*a* joined to the developer containing portion rib 50*a*, and a second joint surface 10*f*11*b* joined to the developing portion rib 50*b*.

Also, as shown in FIGS. 10 and 11, the first frame member 10*f*1 has an arcuate attachment portion 10*f*14 to which, similarly to the attachment portion 10*f*24, the seal member 10*r* is attached.

Further, the second joint surface 10*f*11*b* has a resin reservoir 10*f*12 for storing therein any excess molten resin produced when the first frame member 10*f*1 and the second frame member 10*f*2 are welded and joined together. In the present embodiment, the resin reservoir 10*f*12 is a depression (recess) provided from the second joint surface 10*f*11*b* toward the attachment portion 10*f*14. The resin reservoir 10*f*12 is provided at a location overlapping the developing portion rib 50*b* of the second frame member 10*f*2 during the welding.

Also, the resin reservoir 10*f*12 is provided on the edge of the distal end portion 10*f*13 of the first frame member 10*f*1 which lies on the opposite side (the developing chamber 10*i* side) to the side on which the developer containing portion 10*a* is provided with the developer supplying opening 10*k* interposed therebetween. That is, the depression as the resin reservoir 10*f*12 is provided on the second joint surface 10*f*11*b*, which is the edge of the distal end portion 10*f*13. In this embodiment, the resin reservoir 10*f*12 does not extend through the first frame member 10*f*1 in a direction orthogonal to the lengthwise direction of the first frame member 10*f*1. Also, the attachment portion 10*f*14 and the second joint surface 10*f*11*b* are located on opposite sides. Further, the attachment portion 10*f*14 extends to and is located at the distal end portion 10*f*13 of the first frame member 10*f*1.

The welding of the first frame member 10*f*1 and the second frame member 10*f*2 is effected by a welding horn 133 for imparting ultrasonic vibration, and an anvil 134 when the welding horn 133 is brought into pressure contact.

At that time, the positioning boss 10*f*211 of the second frame member 10*f*2 fits in the positioning hole 10*f*16 of the first frame member 10*f*1. Also, the positioning boss 10*f*212 of the second frame member 10*f*2 fits in the positioning cut-away 10*f*17 of the first frame member 10*f*1. Thereby, the position of the first frame member 10*f*1 relative to the second frame member 10*f*2 is tentatively determined (see FIGS. 5 and 9).

The joint of the first frame member 10*f*1 and the second frame member 10*f*2 by welding will now be described with reference to FIGS. 12 and 13. The first frame member 10*f*1 and the second frame member 10*f*2 having had their positions tentatively determined are held by the welding horn 133 and the anvil 134. The welding horn 133 is located on the back side of the first joint surface 10*f*11*a*. The anvil 134 is astride of the attachment portion 10*f*24 and attachment portion 10*f*14 on the back side of the second joint surface 10*f*11*b*.

When ultrasonic vibration is imparted with the welding horn 133 brought into contact with the second frame member and the welding horn 133 is pressed against the back side of the first joint surface 10*f*11*a*, the welding rib 50 (50*a*, 50*b*) is melted and the first frame member 10*f*1 and the second frame member 10*f*2 are joined together. As shown in FIG. 14A, the attachment portion 10*f*1 and the attachment portion 10*f*24 form the same curved surface.

At this time, the excess molten resin produced by the welding flows into the resin reservoir 10*f*12 (see FIG. 11). The presence of this resin reservoir can prevent the excess resin from leaking out from the distal end of the attachment portion 10*f*14 into the gap with respect to the anvil 134, and becoming a solidified resin lump 135 (see FIG. 14B).

The resin lump 135 is a result of excess resin produced by the unevenness of the shape of the welding rib 50 in the production thereof, and the unevenness of energy impacted to weld and join it, resulting in the resin being melted into a minute space sandwiched between the attachment portions 10*f*14, 10*f*24 and the anvil 134. Also, the size of this minute space is determined by the dimensional accuracy and unevenness of the shapes of the attachment portions 10*f*14, 10*f*24 and the anvil 134, and the positioning accuracy of the first frame member 10*f*1 and the second frame member 10*f*2 relative to the anvil 134.

After the first frame member 10*f*1 and the second frame member 10*f*2 have been joined together as shown in FIG. 15, the seal member 10*r* is attached to the attachment portion 10*f*14 and to the attachment portion 10*f*24. Then, a sheet member 14 for preventing the flowing-out of the developer below the developing roller 10*d* is attached to the second frame member 10*f*2, whereafter the developing roller 10*d* is mounted in the developing frame (the first frame member 10*f*1, the second frame member 10*f*2).

In the present embodiment, the seal member 10*r* is composed of a magnetic material. As shown in FIG. 15, the seal member 10*r* using the magnetic material is attached to the first frame member 10*f*1 and to the second frame member 10*f*2. A gap g2 is provided between the seal member 10*r* and the outer peripheral surface of the developing roller 10*d*.

Reference is now made to FIG. 16 to describe a construction for preventing the leakage of the developer by the seal member 10*r* formed of the magnetic material.

The inner peripheral surface 10*r*3 (a surface opposed to the outer peripheral surface of the developing roller 10*d*) and circumscribing surface 10*r*4 (a surface opposed to the attachment portion 10*f*14) of the seal member 10*r* are magnetized with a plurality of N and S poles. Therefore, the ears of a magnetic brush are prevented from being formed in the gap g2 to thereby cause the developer to leak out from this minute gap.

Also, a magnetic field is formed in a minute gap with respect to the circumscribing surface 10*r*4, the attachment portion 10/14 and the attachment portion 10/24 caused by the unevenness of the manufacturing dimensions of the developing frame (the first frame member 10/1, the second frame member 10/2). Therefore, the developer is prevented from leaking out from this minute gap.

As described above, the resin reservoir 10/12 is provided at the distal end of the second joint surface 10/11*b* of the first frame member 10/1. Accordingly, the resin lump 135 can be prevented from protruding to the attachment portions 10/14 and 10/24 and the seal member 10*r*.

Thereby, the seal member 10*r* is properly attached to the attachment portions 10/14 and 10/24. Therefore, the gap between the seal member 10*r* and the developing roller 10*d* can be kept proper, thereby improving the sealing property for the developer.

Also, the gap between the circumscribing surface 10*r*4 of the seal member 10*r* and the attachment portions 10/14, 10/24 can be minimized and therefore, the sealing property for the developer can be further improved.

SECOND EMBODIMENT

Figure 17:
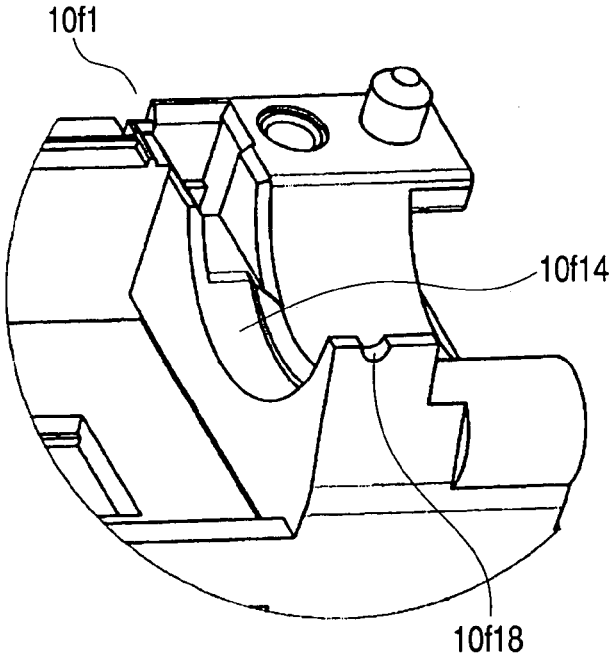
FIG. 17 is a fragmentary perspective view illustrating the shape of a resin reservoir according to a second embodiment.
Figure 18:
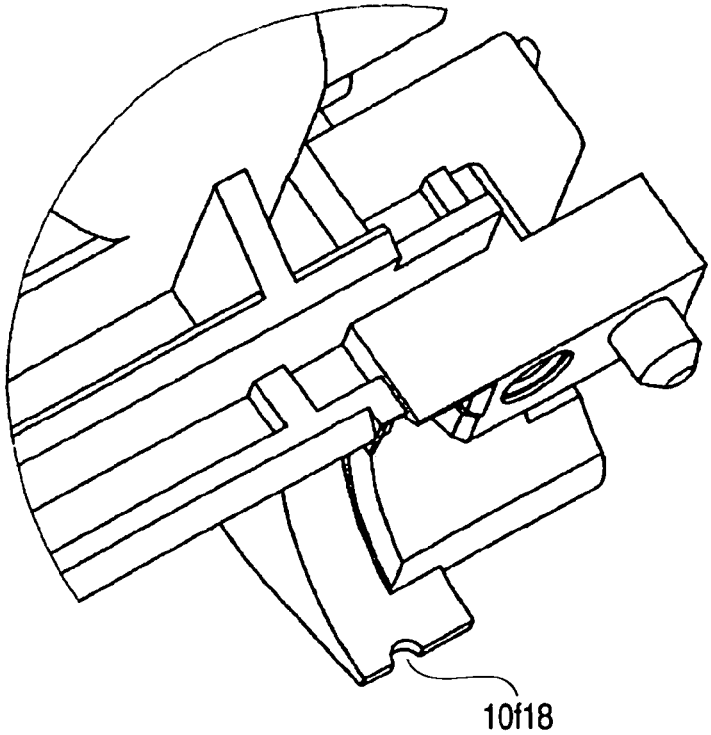
FIG. 18 is a fragmentary perspective view illustrating the shape of the resin reservoir according to the second embodiment.

Another embodiment of the developing frame will now be described with reference to FIGS. 17 and 18. FIGS. 17 and 18 are fragmentary perspective views illustrating the shape of a resin reservoir according to a second embodiment. In FIGS. 17 and 18, portions that are the same as those in the description of the first embodiment are given the same reference characters and need not be described.

As shown in FIGS. 17 and 18, in the second embodiment, a resin reservoir 10/18 is provided at the edge of a distal end portion 10/13. That is, a depression as the resin reservoir 10/18 is provided at the edge of the distal end portion 10/13. In this embodiment, the shape of the resin reservoir 10/18 for storing excess molten resin therein extends through the second joint surface 10/11*b* to the attachment portion 10/14 (from the second joint surface 10/11*b* to the first frame member 10/1 in a direction orthogonal to the lengthwise direction of the first frame member 10/1). The molten resin produced during welding, even in the posture during the welding shown in FIG. 13, is not so low in viscosity as it drips downwardly.

Further, the resin reservoir 10/18 is made into a through-hole, whereby the capacity capable of storing the molten resin therein is increased. Therefore, the resin lump 135 (see FIG. 14B) can be reliably prevented from protruding from the attachment portions 10/14 and 10/24.

Figure 19:
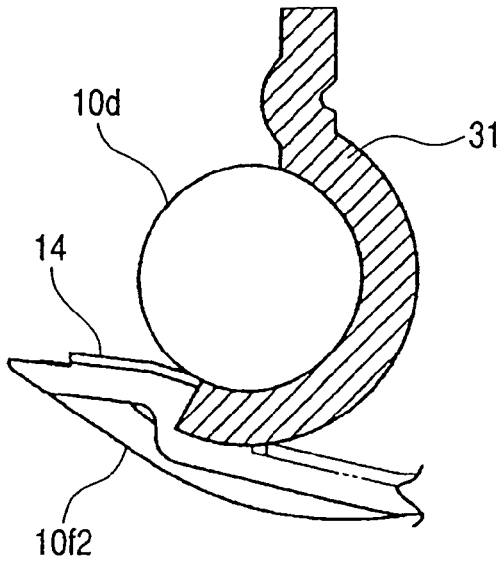
FIG. 19 is a fragmentary cross-sectional view showing the state of a seal member in another embodiment.
Figure 20:
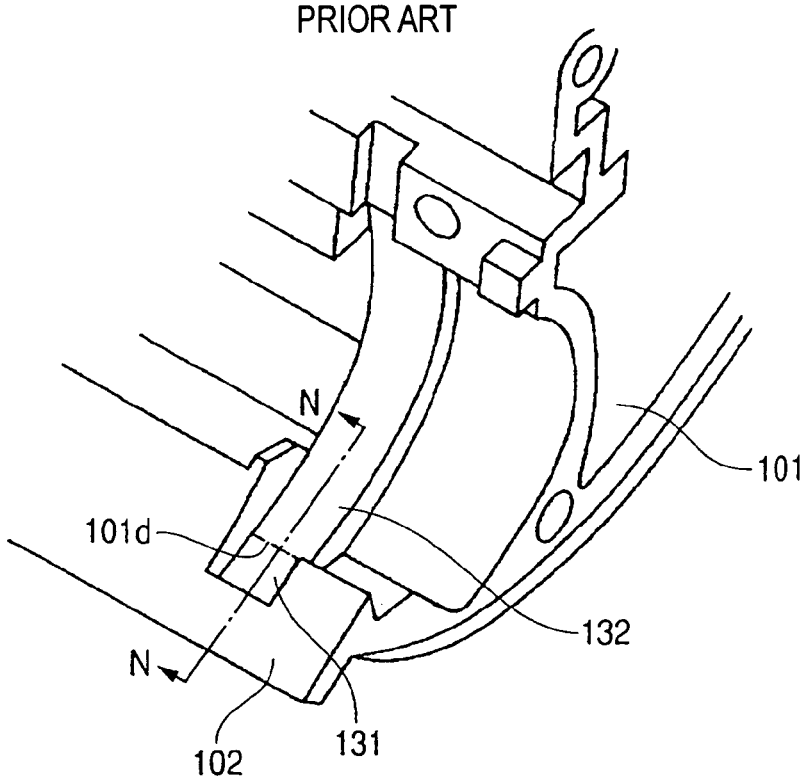
FIG. 20 PRIOR ART
FIG. 20 is a fragmentary perspective view of a conventional developing frame.
Figure 21:
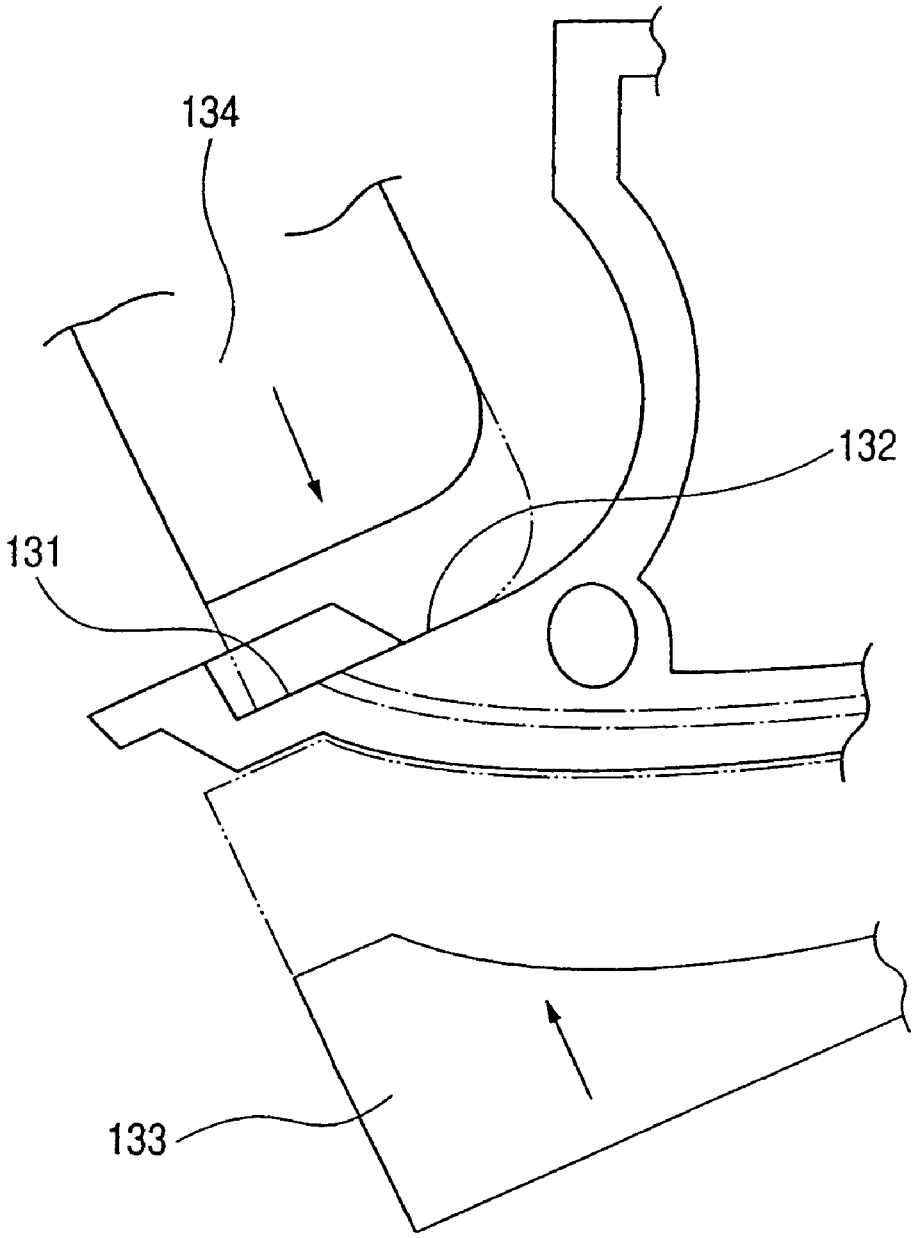
FIG. 21 PRIOR ART
FIG. 21 is a fragmentary cross-sectional view of the conventional developing frame.

The seal member 10*r* need not be the magnetic material described in the first embodiment. As shown, for example, in FIG. 19, use can also be made of a seal member 31 comprising an elastic member stuck on the attachment portions 10/14 and 10/24 by a two-side tape or the like. The seal member 31 can be closely stuck on the attachment portions 10/14 and 10/24 by the two-side tape to thereby effect sealing.

In the present embodiment, there has been shown a construction in which in the joint by the welding according to the above-described embodiment, the attachment portions 10/14 and 10/24 are supported by the anvil 134. However, the design may be made such that the second frame member 10/2 is held by the anvil 134 and also, the welding horn 133 is brought into pressure contact with the first frame member 10/1, and the production of a joint may be done with this structure.

The aforedescribed embodiments may be summed up as follows.

[1] A developing frame having:

a first frame member 10/1 having a developer supplying opening 10*k* provided to supply a developer from a developer containing portion 10*a* containing the developer therein to a developing area (a developing chamber 10*i*);

a second frame member 10/2 joined to the first frame member 10/1 by molten resin;

an attachment portion 10/14 provided on at least the first frame member 10/1, and having attached thereto a seal member 10*r* for preventing the developer from leaking from the lengthwise end portions of a developing roller 10*d*; and a resin reservoir 10/12 depressed from the joint surface 10/11*b* of the first frame member 10/1 and the second frame member 10/2 toward the attachment portion 10/14 and an attachment portion 10/24, and in which the distal end portion 10/13 of the first frame member 10/1 lying on the opposite side (the developing chamber 10*i* side) to the side on which the developer containing portion 10*a* is provided with the developer supplying opening 10*k* interposed therebetween is depressed, and in which the molten resin is stored.

[2] A developing frame having:

a first frame member 10/1 having a developer supplying opening 10*k* provided to supply a developer from a developer containing portion 10*a* containing the developer therein to a developing area (a developing chamber 10*i*);

a second frame member 10/2 joined to the first frame member 10/1 by molten resin;

an attachment portion 10/14 provided on at least the first frame member 10/1, and having attached thereto a seal member 10*r* for preventing the developer from leaking from the lengthwise end portions of a developing roller 10*d*; and a resin reservoir 10/18 extending from the joint surface 10/11*b* of the first frame member 10/1 and the second frame member 10/2 toward the attachment portion 10/14 and an attachment portion 10/24, and in which the distal end portion 10/13 of the first frame member 10/1 lying on the opposite side (a developing chamber 10*i* side) to a side on which the developer containing portion 10*a* is provided with the developer supplying opening 10*k* interposed therebetween is depressed, and in which the molten resin is stored.

[3] A developing frame according to the item [1] or [2] above, wherein the first frame member 10/1 is provided with a resin reservoir 10/12, 10/18, and the second frame member 10/2 is provided with a rib (welding rib 50) formed of resin.

[4] A process cartridge B detachably mountable on an electrophotographic image forming apparatus main body A, the process cartridge B having:

an electrophotographic photosensitive drum 7;

a developing roller 10*d* for developing an electrostatic latent image formed on the electrophotographic photosensitive drum 7;

a developing frame according to any one of the items [1] to [3] above; and a seal member 10*r* attached to an attachment portion 10/14, 10/24.

[5] An electrophotographic image forming apparatus A having:

conveying means 3 for conveying a recording medium 2; and a process cartridge B according to the item [4] above.

As described above, according to the present invention, the sealing property for the developer in the end portions of the developing roller can be improved.

While the invention has been described with reference to the structure disclosed herein, it is not confined to the details set forth and this application is intended to cover such modifications or changes as may come within the purpose of the improvements or the scope of the following claims.

This application claims priority from Japanese Patent Application No. 2003-307911 filed on Aug. 29, 2003, which is hereby incorporated by reference herein.

What is claimed is:

1. A process cartridge detachably mountable on an electrophotographic image forming apparatus main body, said process cartridge comprising:

an electrophotographic photosensitive drum;

a developing roller configured and positioned to develop an electrostatic latent image formed on said electrophotographic photosensitive drum, by use of developer;

a magnetic seal member configured and positioned to prevent by a magnetic force of said magnetic seal member the developer from leaking from a lengthwise end portion of said developing roller;

a developer containing portion containing the developer to be used to develop the electrostatic latent image;

a first frame member made of resin and having a developer supplying opening provided to supply the developer from said developer containing portion to said developing roller;

a second frame member made of resin and joined to said first frame member by molten resin;

an attachment portion provided astride of said first frame member and said second frame member across a joint portion at which said first frame member and said second frame member are joined together; and a resin reservoir configured to store said molten resin to prevent said molten resin from leaking out from said joint portion when said first frame member and said second frame member are joined together, said resin reservoir extending from said joint portion to said attachment portion on a side of said first frame member, and said resin reservoir being covered with said magnetic seal member attached to said attachment portion.

2. A process cartridge according to claim 1, wherein said resin reservoir is provided at an end portion of said first frame member lying on a side of said first frame member opposite to a side on which said developer containing portion is provided with said developer supplying opening interposed therebetween.

3. A process cartridge according to claim 1, wherein said joint portion is an ultrasonic-welded joint portion at which said first frame member and said second frame member are joined together by ultrasonic welding, and said resin is a portion of said second frame member which has been melted when ultrasonically vibrated.

4. A process cartridge according to claim 1 or 2, wherein said first frame member is provided with said resin reservoir, said second frame member is provided with a rib as said resin melted by vibration applied to said second frame member when ultrasonically welded, and said resin reservoir and said rib are disposed so as to overlap each other when said first frame member and said second frame member are joined together.

5. A developing apparatus for use in an electrophotographic image forming apparatus main body, said developing apparatus comprising:

a developing roller configured and positioned to develop an electrostatic latent image formed on an electrophotographic photosensitive drum, by use of developer;

a magnetic seal member configured and positioned to prevent by a magnetic force of said magnetic seal member the developer from leaking from a lengthwise end portion of said developing roller;

a developer containing portion containing the developer to be used to develop the electrostatic latent image;

a first frame member made of resin and having a developer supplying opening provided to supply the developer from said developer containing portion to said developing roller;

a second frame member made of resin and joined to said first frame member by molten resin;

an attachment portion provided astride of said first frame member and said second frame member across a joint portion at which said first frame member and said second frame member are joined together; and a resin reservoir configured to store said molten resin to prevent said molten resin from leaking out from said joint portion when said first frame member and said second frame member are joined together, said resin reservoir extending from said joint portion to said attachment portion on a side of said first frame member, and said resin reservoir being covered with said magnetic seal member attached to said attachment portion.

6. A developing apparatus according to claim 5, wherein said resin reservoir is provided at an end portion of said first frame member lying on a side of said first frame member opposite to a side on which said developer containing portion is provided with said developer supplying opening interposed therebetween.

7. A developing apparatus according to claim 5, wherein said joint portion is an ultrasonic-welded joint portion at which said first frame member and said second frame member are joined together by ultrasonic welding, and said resin is a portion of said second frame member which has been melted when ultrasonically vibrated.

8. A developing apparatus according to claim 5 or 6, wherein said first frame member is provided with said resin reservoir, said second frame member is provided with a rib as said resin melted by vibration applied to said second frame member when ultrasonically welded, and said resin reservoir and said rib are disposed so as to overlap each other when said first frame member and said second frame member are joined together.

* * * * *